US005871405A

United States Patent [19]

Sardo

[11] Patent Number: 5,871,405

[45] Date of Patent: Feb. 16, 1999

[54] POOL BALL RACKING SYSTEM

[76] Inventor: Louis Sardo, 1629 Verdugo Blvd., La Canada, Calif. 91011

[21] Appl. No.: 41,819

[22] Filed: Mar. 12, 1998

[51] Int. Cl.[6] ..... A63D 15/00

[52] U.S. Cl. ..... 473/40

[58] Field of Search ..... 473/40, 41

[56] References Cited

U.S. PATENT DOCUMENTS

| | | | |
|---|---|---|---|
| 831,068 | 9/1906 | Helms . | |
| 1,848,460 | 3/1932 | Budde | 473/40 |
| 2,405,677 | 8/1946 | Volpe | 273/22 |
| 2,422,939 | 6/1947 | Volpe | 473/40 |
| 3,368,810 | 2/1968 | Deering | 473/41 |
| 3,423,087 | 1/1969 | Sowa | 473/41 |
| 4,553,750 | 11/1985 | Kintz | 473/40 |
| 4,903,965 | 2/1990 | Smith | 473/40 |
| 5,531,646 | 7/1996 | Boyle | 473/40 |
| 5,556,341 | 9/1996 | Bonn | 473/40 |
| 5,601,496 | 2/1997 | Beauchamp | 473/40 |

*Primary Examiner*—Theatrice Brown
*Attorney, Agent, or Firm*—Goldstein & Canino

[57] ABSTRACT

A pool ball racking system for tightly and evenly racking a set of pool balls in preparation for a beginning player's break. The system comprises an equilateral triangular racking frame within which the set of pool balls are placed. The racking frame is placed upon a napped felt surface of a pool table, with the pool balls located therein. A vibrating device secured to the racking frame is activated and causes the pool balls to resonate and settle into the nap of the felt surface, thus firmly setting the pool balls in place.

1 Claim, 3 Drawing Sheets

POOL BALL RACKING SYSTEM

FIELD OF THE INVENTION

The invention relates to an improved system for racking pool balls. More particularly, the invention relates to a system for racking pool balls which provides a tight, even rack of a set of billiard balls upon a pool table surface by vibrating and resonating said balls in order to drive and set them down firmly into the nap of the felt which comprises the pool table surface.

BACKGROUND OF THE INVENTION

To initiate play of the many versions of pool which are popular throughout the world, it is necessary to arrange the plurality of balls (often 15, but sometimes 9 for the popular game of nine-ball) into a triangular or diamond shaped pattern such that the apex of the triangle or diamond is positioned directly over a "spot" on the pool table surface. To accomplish this with the most simplicity, pool ball "racks" are almost always employed. These racks are shaped in a standard triangle or diamond to accept 15 or 9 balls as discussed above, and have upstanding walls to retain loaded balls therein. However, to readily accept these loaded balls, typical racks are oversized such that the balls consequently fit quite loosely within the rack.

Because of the loose fit which results from standard racks, it is usually required that the individual racking the balls use his fingers to force the balls forward towards the apex of the rack in order to achieve a tight and even formation of the balls. However, due to human error, the balls are often grouped irregularly in both shape and tightness. As a result, the first player to break the rack of balls is at a disadvantage in that the improperly racked balls do not respond as would be anticipated of a properly racked set of pool balls.

Various devices are found in the prior art which attempt to provide simplified means for properly racking a set of pool balls. Theses devices prove complex and expensive in construction, and fail to provide the desired results. While these prior art units may be suitable for the particular purpose employed, or for general use, they would not be as suitable for the purposes of the present invention as disclosed hereafter.

SUMMARY OF THE INVENTION

The present invention relates to a system for racking billiard balls which provides a tight, even rack of a set of billiard balls upon a pool table surface by vibrating and resonating said balls in order to drive and set them down firmly into the nap of the felt which comprises the pool table surface.

In accordance with the invention, there is provided a billiard ball racking system which comprises a pool ball rack having either integral or detachable vibrating means.

Further in accordance with the invention, there is provided a billiard ball racking system which resonates the pool balls contained within the confines of the pool ball rack so that said balls are caused to settle into the raised nap of the pool table felt surface, thus resulting in a tight and even rack of balls.

Further in accordance with the invention, there is provided a billiard ball racking system which allows the initial break of the racked balls to result in an even and predictable disbursement of the balls from the racked configuration.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
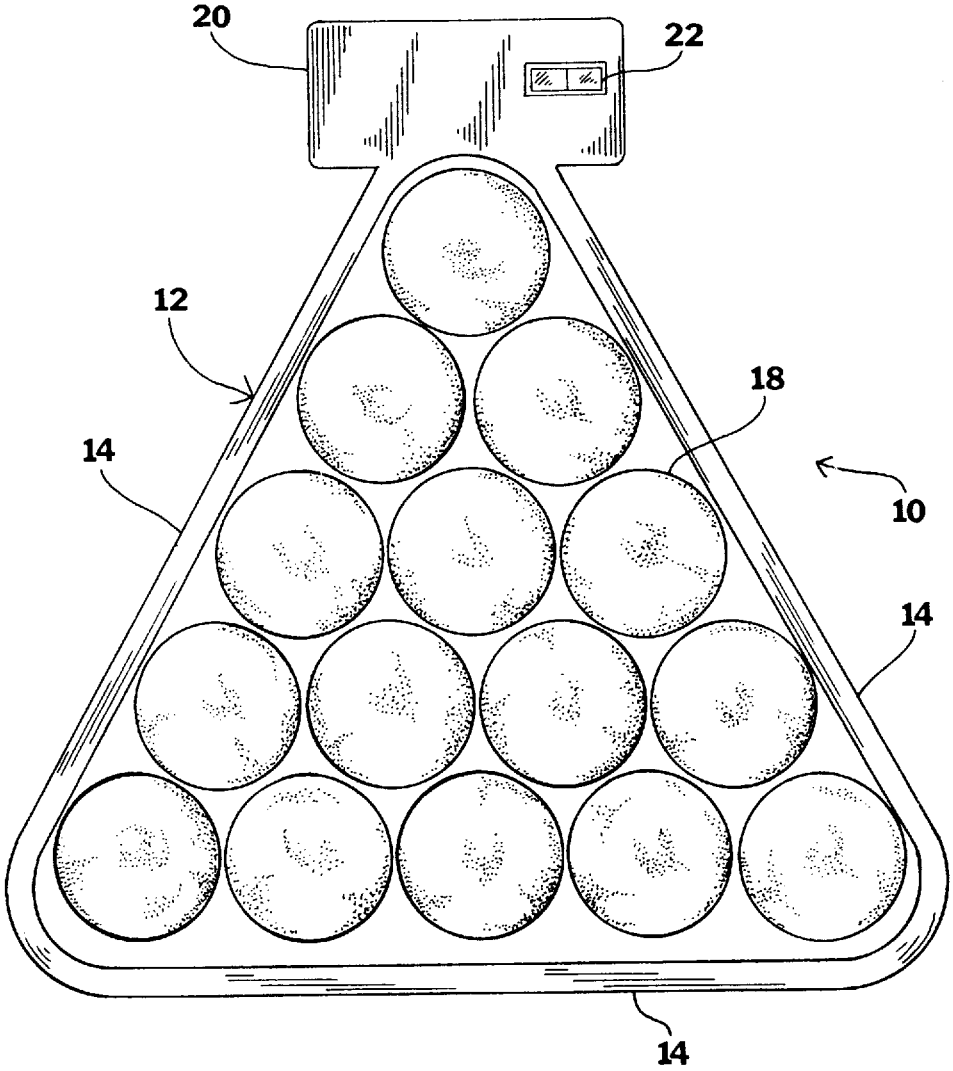
FIG. 1 is a top plan view of a pool ball rack of the instant invention with vibrating means secured thereto.
Figure 2:
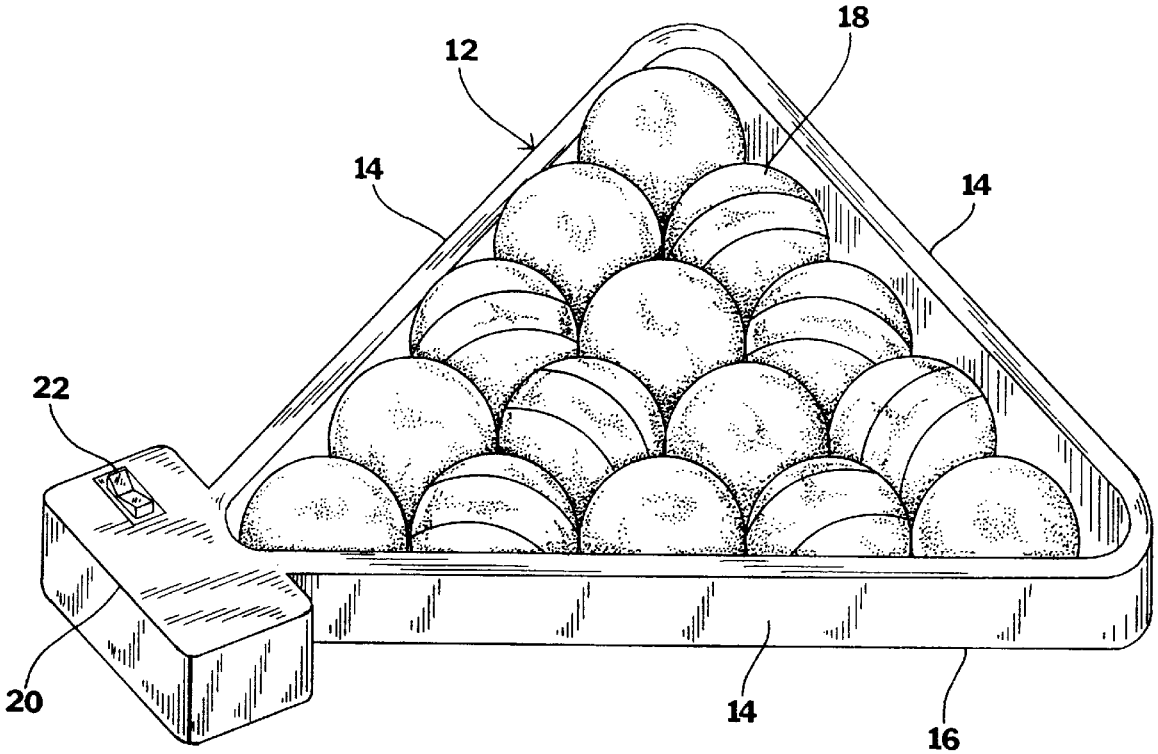
FIG. 2 is a diagrammatic perspective view of the pool ball rack of FIG. 1, with a plurality of pool balls assembled within the confines thereof.

FIGS. 1 and 2 illustrate a pool ball rack 10 of the instant inventive system. The rack 10 comprises a triangular racking frame 12 which is comprised of three equally sized upstanding rails 14. Each upstanding rail 14 has a bottom edge 16, all of the bottom edges 16 terminating in a common plane so that the racking frame 14 may sit flush upon any surface. Fifteen pool balls 18 are assembled within the racking frame 12 in standard pool configuration, whereby five of the fifteen pool balls 18 abut against each of the three upstanding rails 14.

Vibrating means such as an electrically powered vibration device 20 (such devices being well known to those skilled in the art) are secured to the racking frame 12 as seen in FIGS. 1 and 2. In the preferred embodiment, it is contemplated that said vibrating device 20 be an integral component of the racking frame 12 as shown in the accompanying drawings. However, it is also contemplated tat said vibrating device be detachably securable to said racking frame 12. A switch 22 should optimally be in communication with said vibrating device 20 to allow an operator to selectively activate and de-activate said vibrating device 20.

Figure 3:
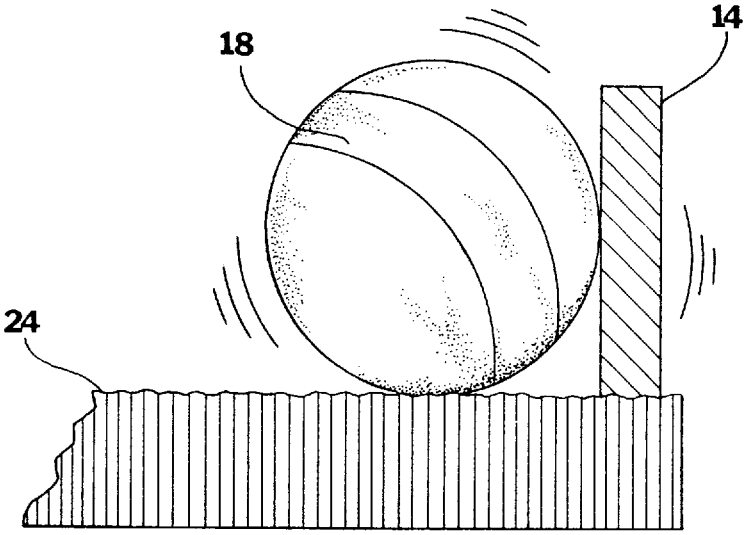
FIG. 3 is a cross section view of one of the upstanding walls of the pool ball rack adjacent to a pool ball which is resting upon a felt surface of the pool table.
Figure 4:
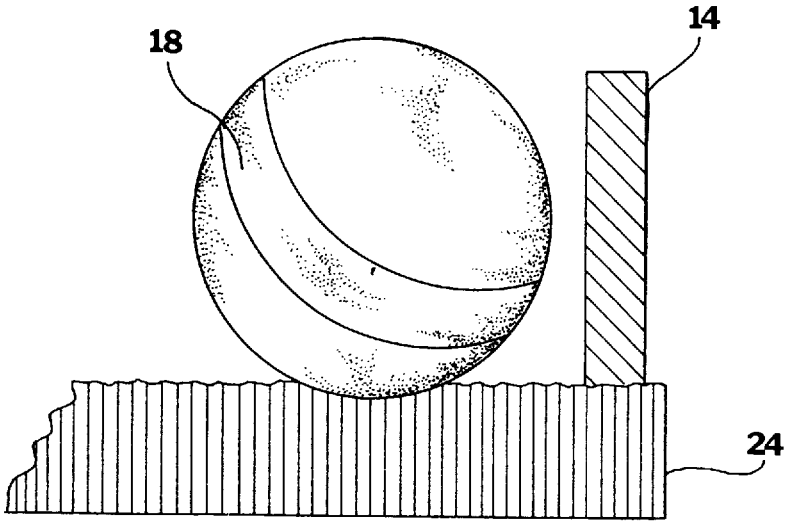
FIG. 4 is a cross section view of one of the upstanding walls of the pool ball rack adjacent to a pool ball which is resting upon a felt surface of the pool table, the pool ball settled into the nap of said felt surface subsequent to being vibrated thereupon.

Upon assembling the fifteen pool balls 18 within the racking frame 12, said balls 18 are usually positioned upon a felt surface 24 of a pool table. This felt surface 24 normally has a nap-like texture to it which supports the pool balls 18 as seen in FIG. 3. When the vibrating device 20 is activated, said pool balls 18 are caused to vibrate and sharply contact each other. This resonance causes the pool balls 18 to settle into the nap of the felt surface 24 as seen in FIG. 4. After a short period of vibration, the switch 22 is utilized to de-activate the vibrating device 20 and cease vibration of the racking frame 12 and pool balls 18. Subsequently, all of the pool balls 18 are set firmly and evenly upon the felt surface 24, in a proper state of readiness for the beginning player's break.

What is claimed is:

1. A pool ball racking system for tightly and evenly racking a set of pool balls upon a napped textured felt surface of a pool table in order to ready said pool balls for play by a player, comprising:

a) three equally sized upstanding rails which are connected to form a triangular racking frame, each upstanding rail having a bottom edge, all of said bottom edges terminating in a common plane so that the racking frame may sit flush upon the napped felt surface of the pool table, the set of pool balls contained within said racking frame; and b) a vibrating device secured to the racking frame, said vibrating device having a switch which allows an operator to selectively activate and de-activate said vibrating device, wherein the racking frame is placed upon the felt surface of the pool table and filled with pool balls which are also positioned upon the felt surface within said racking frame, the vibrating device is activated and the pool balls are caused to vibrate and sharply contact each other, thus causing said pool balls to settle firmly into the napped texture of the felt surface of the pool table, leaving said pool balls set in a state of readiness for the beginning player.

* * * * *